US005114608A

United States Patent [19]

Sluga et al.

[11] Patent Number: 5,114,608

[45] Date of Patent: May 19, 1992

[54] METHOD OF CLEANING HOLLOW FIBER COMPONENTS OF A DIALYZER WITH CHLORO FLUOROCARBON COMPOSITIONS STABILIZED BY EPOXIDIZED FATTY ACID GLYCERIDES OR ESTERS

[75] Inventors: Robert M. Sluga, Gurnee; Randolph H. Watkins, Wonder Lake; Henry M. Gajewski, Winnetka; Jerry D. Fisher, McHenry; Dennis C. Berry, Woodstock, all of Ill.

[73] Assignee: Baxter International Inc., Deerfield, Ill.

[21] Appl. No.: 596,880

[22] Filed: Oct. 12, 1990

[51] Int. Cl.[5] ..... C11D 7/22; C11D 7/50; B08B 7/12; B08B 3/00

[52] U.S. Cl. ..... 252/162; 134/12; 134/31; 134/38; 134/39; 134/40; 252/170; 252/171; 252/172; 252/174.21; 252/364; 252/396; 252/DIG. 9

[58] Field of Search ..... 252/162, 170, 171, 172, 252/364, DIG. 9, 174.21, 396; 134/12, 31, 38, 39, 40

[56] References Cited

U.S. PATENT DOCUMENTS

| | | | |
|---|---|---|---|
| 4,287,003 | 9/1981 | Allen | 252/171 |
| 4,362,573 | 12/1982 | Mackrodt et al. | 252/171 |
| 4,454,052 | 6/1984 | Shoji et al. . | |
| 4,599,187 | 7/1986 | Hey | 252/171 |
| 4,704,225 | 11/1987 | Stoufer | 252/171 |
| 4,715,900 | 12/1987 | Connon et al. | 252/171 |
| 4,767,561 | 8/1988 | Gorski | 252/171 |
| 4,803,009 | 2/1989 | Gorski | 252/171 |
| 4,804,493 | 2/1989 | Gorski | 252/171 |
| 4,836,947 | 6/1989 | Lund et al. | 252/171 |
| 4,842,764 | 6/1989 | Lund et al. | 252/171 |
| 4,863,630 | 9/1989 | Swan et al. | 252/171 |
| 4,894,176 | 1/1990 | Swan et al. | 252/171 |
| 4,973,421 | 11/1990 | Tamura et al. | 252/162 |
| 5,035,831 | 7/1991 | Magid et al. | 252/170 |

FOREIGN PATENT DOCUMENTS

| | | |
|---|---|---|
| 64-201957 | 11/1987 | Japan . |
| 0295192 | 11/1987 | Japan . |
| 64-195632 | 5/1989 | Japan . |
| 1-165698 | 6/1989 | Japan . |
| 1-221333 | 9/1989 | Japan . |
| 1534734 | 12/1978 | United Kingdom . |

OTHER PUBLICATIONS

Swift Chemical Company, Technical Bulletin, Epoxol 9-5.

American Chemical Service, Inc., Epoxol 9-5 (Epoxidized Linseed Oil), 1990.

*Primary Examiner*—A. Lionel Clingman
*Assistant Examiner*—William S. Parks
*Attorney, Agent, or Firm*—Philip G. Meyers; Charles R. Mattenson

[57] ABSTRACT

A method of stabilizing chlorofluorocarbon compositions thereby is provided. The stabilized composition comprises a chlorofluorocarbon and a sufficient amount of an epoxidized, generally high molecular weight stabilizer having an oxirane content sufficient to effectively stabilize the chlorofluorocarbon. The stabilizer is preferably an epoxidized oil having a molecular weight in the range of about 300 to about 1,500 and an oxirane content of at least about 4%. The method includes the step of adding a sufficient amount of such a stabilizer to the chloroflurocarbon composition. The chlorofluorocarbon composition typically comprises chlorofluoromethane, chlorofluoroethane, mixtures thereof or a chlorofluorocarbon-alcohol azeotropic solution. Also provided is an improved continuous dialyzer cleaning method utilizing the stabilized chlorofluorocarbon composition.

12 Claims, No Drawings

METHOD OF CLEANING HOLLOW FIBER COMPONENTS OF A DIALYZER WITH CHLORO FLUOROCARBON COMPOSITIONS STABILIZED BY EPOXIDIZED FATTY ACID GLYCERIDES OR ESTERS

TECHNICAL FIELD OF THE INVENTION

This invention relates, in general, to the stabilization of chlorofluorocarbon compounds and compositions comprising chlorofluorocarbons. More particularly, this invention relates to the stabilization of chlorofluorocarbon-alcohol azeotropes which are known to be useful cleaning solutions for cleaning medical devices, such as dialyzers.

BACKGROUND OF THE INVENTION

Chlorofluorocarbons (CFC's) are useful in a wide variety of applications, such as refrigerants, propellants, solvents and the like. Many CFC solvents such as chlorofluoromethanes and chlorofluoroethanes are known to provide safe and reliable cleaners and are useful in numerous applications. For example, 1,1,2-trichlorotrifluoroethane is widely used as an agent for removing oil, grease and related contaminants from many plastic materials. That use, however, also poses the same environmental problems described above. Therefore, stabilization of these CFC cleaning solutions is also desirable.

CFC's are also used in conjunction with other materials in cleaning applications. For example, CFC-alcohol azeotropic cleaning solutions are all widely used in cleaning medical devices such as dialyzers. Dialyzers, or "artificial kidneys", function as superfine strainers, permitting passage of molecules only up to a certain size through semi-permeable membranes used therein. Dialyzers, in effect, perform the functions of the kidney in removing waste from the blood and regulating the body's internal environment.

One known dialyzer configuration is a capillary flow dialyzer, comprised of a plurality of hollow fibers contained within a housing. Such capillary flow dialyzers may be manufactured in any number of ways. In one process, the fibers are extruded using isopropyl myristate as a lubricant. Isopropyl myristate, while effective as a lubricant, tends to leave a residue on the fiber which must be cleaned prior to use. Other contaminants may also be generated or deposited on the fiber surfaces as a result of the manufacturing and assembly of such dialyzers. These contaminants too must be cleaned prior to use, because their presence could cause a reaction in patients ultimately using the device.

One known CFC-alcohol azeotropic cleaning solution is Freon/TP Azeotrope which includes about 97 weight percent Freon TF and about 3 weight percent isopropanol. (Freon is a registered trademark of the E. I. duPont de Nemours Co., Wilmington, Del., USA). Freon/TP Azeotrope is known to provide an efficient, high quality cleaning solution enabling both alcohol soluble residues and non-alcohol soluble residues to be cleaned from an article such as a dialyzer.

While beneficial as a cleaning solution, it is known that under certain circumstances, such as are present during the process of cleaning dialyzers, Freon TF (a component of Freon/TP Azeotrope) will react with the alcohol to release hydrochloric acid (HCl) or, alternatively, any evolved chloride will protonate in the environment to yield the acid. This production of hydrochloric acid (HCl) causes the pH in the cleaning system to drop to a pH generally below 4.5 to 7.0, the normal range for Freon azeotropes. In turn, stainless steel in the cleaning apparatus itself undergoes a conversion reaction in this chloride rich acidic environment. More particularly, after several hours of operation, the stainless steel, the water separators, and the water flush of the cleaning apparatus using Freon/TP may turn green. Such "green outs" are indicative of corrosion of the apparatus which can be so severe that it causes irreparable pitting. Additionally, these "green outs" can cause damage to the medical devices, e.g., dialyzers, being cleaned.

Hydrochloric acid (HCl) is likely produced due to a reaction between the major components of the azeotropic cleaning solution. Particularly, it is believed that the Freon TF ($CF_2ClCFCl_2$) reacts with the isopropanol ($(CH_3)_2CHOH$) according to the following mechanism:

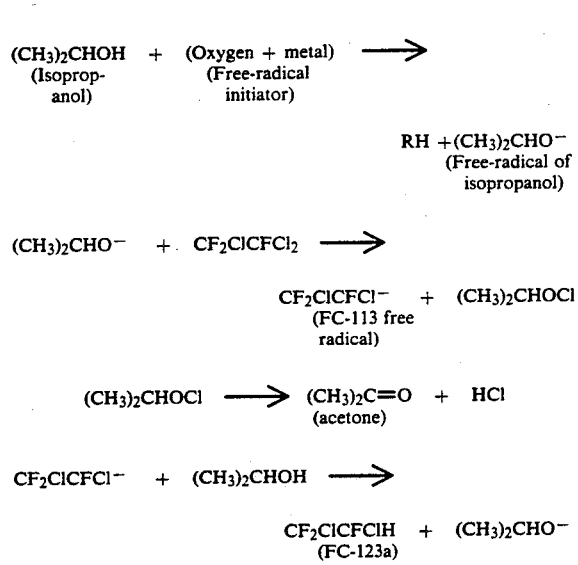

The generation of hydrochloric acid according to this mechanism continues as long as the conditions permit, unless it is inhibited, neutralized or stabilized.

Known methods of stabilizing CFC compositions are disclosed in Japanese Patent No. 1,221,333 published Sep. 4, 1989 and U.S. Pat. No. 4,454,052 issued Jun. 12, 1984. These methods involve the use of epoxides which are disclosed as being useful for stabilizing the chlorofluorocarbon and inhibiting corrosion of metal. These compounds when reacted form highly toxic, possibly carcinogenic materials, rendering them unsuitable for use in cleaning medical devices, such as dialyzers.

Conventional stabilizers for chlorofluorocarbonalcohol azeotropes include nitromethane, 3-methyl-1-butyne-3-ol, glycidol, phenyl glycidyl ether, dimethoxymethane, hexene, cyclopentine, allyl alcohol, methacrylate, and butacrylate. See Japanese Patent No. 1,165,698 published Jun. 29, 1989. The toxicity and volatility of these compounds, like those mentioned above, render them unsuitable for cleaning medical devices of the type which can be cleaned in accordance with the present invention.

This invention addresses the corrosion problem known to occur through use of CFC cleaning compositions in certain environments. In particular, this invention provides a mechanism to effectively, safely and in a reproducible manner, scavenge the acid produced through the use of chlorofluorocarbon-alcohol azeotropic solutions in conventional cleaning applications. Operator inhalation of chlorine is reduced or eliminated.

SUMMARY OF THE INVENTION

A stabilized composition is provided which includes at least one halogenated hydrocarbon such as a chlorofluorocarbon, and an epoxidized stabilizer having a substantial oxirane content which effectively stabilizes the halogenated hydrocarbon. The stabilizer reacts with chloride ions to form one or more non-toxic by-products.

A method of stabilizing chlorofluorocarbon compositions is also provided which includes the step of adding to a fluid comprised of a CFC a sufficient amount of an epoxidized stabilizer having a high molecular weight. Preferably the chlorofluorocarbon composition comprises chlorofluoromethane, chlorofluoroethane, mixtures thereof or an azeotropic solution of a chlorofluorocarbon and an alcohol.

Additionally provided is an improved continuous dialyzer cleaning method wherein a chlorofluorocarbon-alcohol azeotropic solution is refluxed to clean the hollow fiber components of the dialyzer. The method is improved by adding to the chlorofluorocarbon-alcohol azeotropic solution prior to refluxing an epoxidized stabilizer which reacts with hydrochloric acid generated during cleaning. This method also inhibits the corrosive effects of using these types of cleaning solutions in corrosion sensitive environments.

DETAILED DESCRIPTION OF PREFERRED EXEMPLARY EMBODIMENTS OF THE INVENTION

Epoxidized stabilizers scavenge the hydrochloric acid (HCl) generated through use of CFC compositions, thus inhibiting their corrosive effects and lessening their other potentially harmful effects, such as those on the atmosphere. According to the invention, these results can be achieved by using an epoxidized stabilizer having a relatively high molecular weight. The stabilizer according to the invention is preferably a substituted or unsubstituted hydrocarbon having one or more epoxide groups, a molecular weight of at least about 300, and an overall oxirane content of at least 1 wt. %, preferably at least about 4 wt. %. While there is no known upper limit to either the molecular weight or the oxirane content, ranges of 300–1,500, especially 400–1,100 for molecular weight and 1–40 wt. %, particularly 4–11 wt. % oxirane content are suitable.

High molecular weight stabilizers are preferred for a variety of reasons. Reaction products of epoxidized, relatively high molecular weight hydrocarbon derivatives with hydrochloric acid tend to be less toxic than comparable reaction products of low molecular weight epoxides. Low molecular weight epoxides have a tendency to be absorbed by the medical device being cleaned, which might require residual analysis of the device after cleaning, and have a higher volatility which poses a safety hazard during the cleaning operation. However, if the cleaning composition is to be used to clean hollow dialyzer fibers of small diameter, the molecular weight of the stabilizer should not be so great as to prevent stabilizer molecules from entering and leaving the fibers.

Epoxidized unsaturated fatty acids, especially esters or glycerides thereof, are preferred. Natural animal and vegetable oils contain glycerides of common fatty acids having 8 or more carbon atoms, most commonly 8–18 carbon atoms. The double bonds of these polyunsaturated compounds can be epoxidized to provide epoxidized fatty acid glycerides suitable as the stabilizer of the invention. Examples of usable common oils include linseed, sunflower, safflower, peanut, corn, tall and soybean oils. These oils, in epoxidized form, contain a major portion of epoxidized glycerides of oleic, linoleic, and linolenic acids in varying proportions, together with a minor portion (up to about 22 wt. % for peanut oil) of saturated fatty acids. Epoxidized linseed and soybean oils are especially preferred. The oil may be esterified prior to oxidation, e.g., to form epoxidized octyl tallate from tall oil.

Oxirane content, as used herein, is the percentage by weight of oxirane oxygen, i.e. the oxygen contained in the epoxide groups, forming the molecule. An epoxide group is one having the structure:

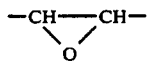

The oxirane content of a molecule may be determined by conventional standard methods, such as AOCS Method Cd-9-57. The oxirane content of the molecules useful in accordance with the present invention is preferably as high as possible to minimize the amount of stabilizer needed, preferably 1–40 wt. %, normally in the range of from about 4 to about 15 wt. %.

These compounds, when utilized with conventional chlorofluorocarbon compositions, produce the unexpected result of stabilizing the CFC such that the acid produced through use of the CFC does not deleteriously affect the environment in which the composition is used and thus, harmful atmospheric effects are lessened. When the terms "stabilize" or "stabilization" are used herein, they are apt respecting CFC compositions broadly, insofar as the overall composition is stabilized against the adverse consequences of $Cl^-$ evolution; however, the terms may be somewhat inapt respecting pure CFC when the epoxide is more accurately viewed as a scavenger. Regardless, these terms will be used for the sake of convenience, as those skilled in the art will have no difficulty interpreting the scope of the invention.

Those of ordinary skill in the art would not expect the high molecular weight compounds employed as the instant stabilizers to beneficially react with the CFC or yield any beneficial results. Rather, those skilled in the art might expect the oxirane groups of these compounds to be inhibited from acting in any positive manner due to the large size of the molecule. Quite contrary to the accepted wisdom, and in opposition to the teachings of the prior art, the inventors herein have discovered that such molecules, as generally described above, yield these results when used in accordance with the present teachings.

It is postulated that the compounds utilized in accordance with the present invention stabilize the CFC composition by reacting with liberated hydrochloric acid (HCl) in the following manner:

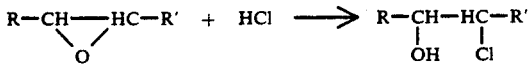

wherein R and R' are representative of substituted or unsubstituted hydrocarbon chains. The high molecular weight of compounds useful in accordance with the present invention does not significantly impede this reaction.

Preferred compositions which can be stabilized in accordance with the present invention include CFC's and compositions comprising CFC's. Exemplary of the CFC's useful in this invention include those chlorofluorocarbons marketed by E. I. duPont de Nemours under the trademark Freon and similar compounds marketed by other companies. This invention is particularly advantageous for those CFC's manufactured for solvent applications and mixtures of such compounds.

Exemplary of the compositions comprising CFC's in conjunction with which the present invention may be used are CFC-alcohol mixtures. Particularly, those CFC-alcohol azeotropic solutions conventionally utilized in cleaning applications have been found to be effectively stabilized through use of the compounds disclosed herein without deleteriously affecting the cleaning action of such azeotropic solutions. A particularly preferred mixture useful in accordance with the present invention is Freon TP/Azeotrope, which comprises from about 97 weight percent of the trichlorotrifluoroethane Freon TF and about 3 weight percent isopropanol.

The cleaning composition of the invention contains as its primary component a halogenated, low-molecular weight hydrocarbon, particularly a $C_1$–$C_4$ hydrocarbon wherein some or preferably all hydrogen atoms have been replaced by fluorine or chlorine atoms. Alcohols useful in the composition of the invention are preferably lower $C_1$–$C_4$ alcohols, such as methanol, ethanol, propanol, isopropanol, butanol, etc. that can form an azeotropic mixture with the halogenated hydrocarbon. Such a mixture effectively reduces the amount of alcohol released into the environment in which the cleaner is used, thus rendering the cleaning composition less hazardous.

Preferred compounds useful to stabilize these CFC's and mixtures of CFC's, in accordance with the invention, include epoxidized oils esters and glycerides, such as epoxidized linseed oil and soybean oil. Epoxidized linseed oil having an average molecular weight preferably between 950 and 1,100 and an oxirane content of between 9 and 11 percent are preferred. Particularly preferred is Epoxol 9-5 manufactured and distributed by American Chemical Service, Inc., Griffith, Ind. Epoxol 9-5 is a highly reactive epoxidized triglyceride, having an average of 5½ reactive epoxy groups per molecule. Epoxol 9-5 has an approximate molecular weight of 980 and an oxirane content of about 9%. Epoxol 9-5 is known to be useful as a plasticizer or stabilizer in polyvinyl chloride or other polyvinyl halide resins. See, American Chemical Service, Technical Bulletin, 1990. Epoxol 9-5 has, however, heretofore not been reported to stabilize Freon compositions.

Monomeric or polymeric epoxidized soybean oils are also exemplary of the compounds useful in accordance with the present invention. In particular, monomeric epoxidized soybean oils useful in accordance with the present invention have an average molecular weight preferably between 700 and 1,000 an an oxirane content of between about 5 and about 7 percent. Polymeric epoxidized soybean oils having a molecular weight in the range of about 1,000 and an oxirane content of between about 6 and about 7 percent also may be utilized. Particularly preferred are Paraplex 60 and Paraplex 62, both available from C. P. Hall Company, Inc., of Chicago, Ill.

Epoxidized octyl tallate (octyl (polyepoxy) tallate) is exemplary of esters useful in accordance with the present invention. Epoxidized octyl tallate, like the epoxidized oils referred to above, preferably has a generally high molecular weight in the range in excess of about 400, and more preferably in the range of about 400 to about 420. Moreover, the epoxidized octyl tallates useful in accordance with the present invention preferably have an oxirane content in the range of between about 4 and about 5 percent. It should be appreciated by those skilled in the art that the above compounds are only exemplary of preferred embodiments of the invention and the present invention is not limited thereby.

In practice, the compounds useful in accordance with the present invention may be added directly to the CFC or composition containing CFC in an amount sufficient to stabilize the CFC. Preferably, the particular compound will be added in an amount such that there is some excess available to react with all of the hydrochloric acid (HCl) generated through use of the CFC.

When used with CFC compositions useful in cleaning applications, the compounds of the invention may be added directly to the CFC composition prior to its use. Alternatively, the compounds of the invention may be added periodically over the course of a continuous cleaning process to continually scavenge the acid produced during such process. For example, when used in conjunction with cleaning compositions such as Freon TP/Azeotrope, described above, these additions may be made at or near the air-vapor interface of the cleaning apparatus which is employed to clean the particular devices, such as dialyzers and the like.

Preferably, the stabilizer compounds useful in accordance with the present invention are added in an amount in excess of about 0.01% by volume per total volume of CFC or composition comprising CFC which is utilized. More preferably, such compounds are added in an amount from about 0.01 to 10.0% by volume and even more preferably in an amount from about 0.02% to about 2.0% by volume of CFC or CFC composition utilized. When used with CFC cleaning compositions, such as Freon TP/Azeotrope, the amount of stabilizer utilized must be sufficient to effectively scavenge the acid generated during the use of the cleaning solution according to conventional cleaning procedures. In general, the amount used should be sufficient to maintain the pH of the composition of at least 4.5 during the contemplated use.

The balance of the composition normally consists of varying proportions of the halogenated hydrocarbon (CFC) and the alcohol. The halogenated hydrocarbon is generally used in an amount of about 90–99 wt. % with 1–10 wt. % of the alcohol, as needed to form an azeotropic mixture. Other proportions could be employed if it is not essential to form an azeotropic mixture. Other materials conventionally utilized in those cleaning procedures may also be added in conjunction with the compounds useful in accordance with the invention. These other materials include, without limitation, additional quantities of the cleaning solution or components thereof, distilled water and the like.

The stabilizer compounds of the invention and the method of using such compounds to stabilize CFC's and CFC compositions will now be described by the following examples, which are for the purpose of illustration only and are not in any way to be construed as limiting.

EXAMPLE 1 (CONTROL)

A reflux test was run with 485.6 grams of Freon TP/Azeotrope in a 500 ml. Pyrex® Erlenmeyer flask equipped with Pyrex, water cooled condensers capped with desiccant tubes containing Dryrite®. Teflon® sleeves were used to seal the ground-glass joints. A boiling chip was used to produce even boiling of the solvent. Two stainless steel 304 specimens (120 grit finish, $1\frac{1}{4}'' \times \frac{3}{8}'' \times 1/16''$) were used. One of these chips was completely immersed in the liquid, the other was placed and held at the solvent vapor-air interface.

After seven (7) days of reflux, a portion of the solvent was removed and analyzed for FC-123 ($CF_2ClCFClH$) and acetone ($(CH_3)_2C{=}O$). The results of this analysis were then converted to equivalent $Cl^-$ (i.e., chloride ion) to evaluate total $Cl^-$ concentration (ppm). Another portion of the solvent was obtained by first extracting 50 ml of solvent from the cleaning apparatus and adding to that extraction an equal volume of distilled water. The sample was analyzed for $Cl^-$ in the solvent (i.e., water phase) and pH measurements were taken with standard pH electrodes.

The total $Cl^-$ determined was 17.2 ppm. The $Cl^-$ in solvent obtained was 5.6 ppm. The pH observed was 4.0. The metal sample immersed in the liquid had a green appearance. The metal sample placed and held at the vapor-air interface had a dark film and spotty corrosion was observable.

EXAMPLE 2

The reflux test described in Example 1 was repeated, but adding 0.02% (by volume) of Epoxol 9-5 to the volume of Freon TP in the flask. After seven (7) days of reflux, two solvent/samples were collected in the same manner as described in Example 1. The same tests described in Example 1 were then performed on these two samples.

It was determined that 0.4 ppm $Cl^-$ was in the solvent and 19.0 ppm $Cl^-$ total was present. A pH of 6.3 was measured. Very little corrosion, less than 0.15 mils/year (yr.), occurred at both the liquid and vapor-air interface. Neither metal chip exhibited a visible change in appearance.

EXAMPLE 3

A reflux solution similar to that described in Example 1 was prepared, this time with the addition of 2.0% (by volume) Epoxol 9-5 to the Freon TP/Azeotrope in the flask. The solution was refluxed for seven (7) days. Then, two samples of the solvent were collected in the same manner as described in Example 1 and the corrosion tests described in Example 1 were performed on those samples.

It was observed that 0.2 ppm $Cl^-$ was present in the solvent and 78.0 ppm $Cl^-$ total was present. A pH of 6.04 was measured. Slightly more corrosion was observed than with use of 0.02% (by volume) Epoxol 9-5; however, all corrosion ratings were below 0.25 mils/yr. The liquid and vapor-air metal samples exhibited some discoloration, but no signs of corrosion.

The results of Examples 1-3 are summarized in Table 1 below, with the results of Example 1 containing no compound of the invention being listed as "Control".

TABLE 1

| | Control | Example 2 | Example 3 |
|---|---|---|---|
| ppm $Cl^-$ solvent | 5.6 | 0.4 | 0.2 |
| ppm $Cl^-$ total | 17.2 | 19.0 | 78.0 |
| pH | 4.0 | 6.3 | 6.04 |
| Corrosion (Mils/yr.) | | | |
| Liquid | 1.6 | 0.04 | 0.14 |
| Vapor-air | 7.0 | 0.12 | 0.24 |
| Appearance | | | |
| Liquid | green | no change | pale yellow |
| Vapor-air | dark film-spotty corrosion | no change | slight film - no corrosion |

From these results, it can be seen that the addition of Epoxol 9-5 is effective to scavenge acid at the 0.02 vol./% level in Freon TP/Azeotrope. Moreover, these examples demonstrate that the compounds of the present invention scavenge the acid effectively, but do not inhibit the free radical production of free chlorine. Nevertheless, the corrosive effect of the free chlorine is inhibited.

EXAMPLE 4

Two Soxhlet extractors were arranged for continuous extraction of a passivated 304 stainless steel strip with Freon TP/Azeotrope. As is known by those skilled in the art, in such extractors the boiling solvent is condensed into the body of the extractor over the sample contained in a porous thimble, the extract being siphoned into the boiling flask when the level of the solvent in the extractor exceeds the level in the sidearm siphon tube.

In one extractor, 400 ml of Freon TP/Azeotrope and 2 ml of distilled water were added to the boiling flask. One $6'' \times 1''$ strip of passivated 304 stainless steel was placed into the distillate chamber. In the other extractor, 400 ml of Freon TP/Azeotrope, 2 ml of distilled water, and 1% by volume of Epoxol 9-5 plasticizer were added to the boiling flask. One $6'' \times 1''$ strip of passivated 304 stainless steel was placed into the distillate chamber.

The Soxhlet extractors were caused to boil for one week. Each day the extractors were checked for corrosion product or the appearance of a green color on the stainless steel strips or in the distillate chamber. After 3 days, the stainless steel strip in the first Soxhlet extractor, i.e., the one not containing Epoxol 9-5, rusted and became pitted. After 7 days of continuous boiling, the stainless steel strip in the Soxhlet extractor containing the Epoxol 9-5 showed no signs of breakdown.

From the foregoing, it should be appreciated that the compounds utilized in accordance with the invention effectively, safely and in a reproducible manner scavenge the acid produced through by CFC's and compositions comprising CFC's. In particular, the compounds of the invention are advantageous in stabilizing CFC cleaning compositions, such as Freon TP/Azeotrope, when such compositions are used in conventional cleaning applications. Moreover, use of the compounds of the invention does not impair the cleaning action of these cleaning compositions, and such compounds do not themselves leave behind residues potentially harmful when the cleaning compositions are used to clean medical devices such as dialyzers.

It will be understood, however, that the above description is of preferred exemplary embodiments of the invention, and that the invention is not limited to the specific forms shown. Modifications may be made in the specific arrangements described herein without departing from the scope of the present invention as expressed in the appended claims.

We claim:

1. A method for cleaning hollow fiber components of a dialyzer, which comprises refluxing such hollow fiber components in a chlorofluorocarbon-alcohol mixture within a cleaning apparatus having a metal surface exposed to the mixture under conditions which generate hydrochloric acid in the mixture, wherein the mixture contains a stabilizer in an amount effective to scavenge hydrochloric acid generated in the mixture and maintain a pH of at least about 4.5 during cleaning, the acid reacting with epoxide groups of the stabilizer to form non-toxic byproducts, whereby the stabilizer is effective for preventing corrosion of the exposed surface, and wherein the mixture consists essentially of 90 to 99 wt. % of a $C_1$–$C_4$ chlorofluorocarbon and 1 to 10 wt. % of a $C_1$–$C_4$ alcohol, and the stabilizer consists essentially of 0.01 to 10% by volume of the mixture of a stabilizer consisting essentially of an epoxidized fatty acid glyceride or ester having a molecular weight of at least 300 and an oxirane content of at least about 4%.

2. The method of claim 1, wherein the stabilizer is present in an amount from about 0.2% to about 2.0% by volume of the mixture.

3. The method of claim 1, wherein the stabilizer consists essentially of epoxidized unsaturated $C_8$–$C_{18}$ fatty acid triglycerides.

4. The method of claim 3, wherein the stabilizer has an oxirane content of about 9%.

5. The method of claim 1, wherein the stabilizer has a molecular weight in the range of about 300 to 1,500 and an oxirane content in the range of from about 4% to 15%.

6. The method of claim 1, wherein the exposed surface of the cleaning apparatus is made of stainless steel.

7. The method of claim 1, wherein said mixture is azeotropic.

8. The method of claim 1, wherein said chlorofluorocarbon is trichlorotrifluoroethane and said alcohol is isopropanol.

9. The method of claim 1, wherein said stabilizer is an epoxidized unsaturated vegetable oil.

10. The method of claim 1, wherein said stabilizer comprises an epoxidized polyunsaturated oil having a molecular weight in the range of about 700 to about 1,000 and an oxirane content in the range of about 5 to about 7%.

11. The method of claim 8, wherein said stabilizer is an epoxidized linseed oil.

12. The method of claim 1, wherein said stabilizer is an epoxidized alkyl tallate having an oxirane content in the range of about 4 to about 5%.

* * * * *